US010309043B2

(12) United States Patent
Hellot et al.

(10) Patent No.: US 10,309,043 B2
(45) Date of Patent: Jun. 4, 2019

(54) INSTALLATION AND A METHOD FOR FABRICATING A FIBER TEXTURE IN THE FORM OF A STRIP PRESENTING A PROFILE THAT VARIES IN CROSS-SECTION

(71) Applicant: SAFRAN AIRCRAFT ENGINES, Paris (FR)

(72) Inventors: Jérémy Hellot, Moissy-Cramayel (FR); Hubert Jean Marie Fabre, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/081,339

(22) PCT Filed: Mar. 2, 2017

(86) PCT No.: PCT/FR2017/050470
§ 371 (c)(1),
(2) Date: Aug. 30, 2018

(87) PCT Pub. No.: WO2017/149252
PCT Pub. Date: Sep. 8, 2017

(65) Prior Publication Data

US 2019/0062962 A1 Feb. 28, 2019

(30) Foreign Application Priority Data

Mar. 2, 2016 (FR) ..... 16 51741

(51) Int. Cl.
*B29C 70/32* (2006.01)
*B29C 53/80* (2006.01)
(Continued)

(52) U.S. Cl.
CPC ..... *D03D 49/20* (2013.01); *D03D 41/004* (2013.01); *D03D 2700/0111* (2013.01)

(58) Field of Classification Search
CPC ..... B29B 11/16; B29C 53/821; B29C 70/32; B29C 53/585; B29C 53/8016;
(Continued)

(56) References Cited

U.S. PATENT DOCUMENTS 3,907,004 A * 9/1975 Yamaguchi ..... B29C 53/586 138/118
3,963,185 A * 6/1976 Quirk ..... B29C 53/76 242/437.1
(Continued)

FOREIGN PATENT DOCUMENTS

CN 201 128 797 Y 10/2008
EP 0 302 012 A1 2/1989
(Continued)

OTHER PUBLICATIONS

International Preliminary Report on Patentability and the Written Opinion of the International Searching Authority as issued in International Patent Application No. PCT/FR2017/050470, dated Sep. 4, 2018.
(Continued)

*Primary Examiner* — Robert H Muromoto, Jr.
(74) *Attorney, Agent, or Firm* — Pillsbury Winthrop Shaw Pittman LLP

(57) ABSTRACT

An installation for fabricating a fiber texture in the form of a strip presenting a profile that varies at least in cross-section includes a loom, one or more take-up rollers, and a storage mandrel, each take-up roller and the storage mandrel presenting a radius that varies across its axial width so as to define an outer surface having a profile in relief. One or more take-up rollers include a plurality of sectors releasably
(Continued)

fastened on the outer surface of the take-up roller. Each sector extends over a fraction of the circumference of the take-up roller and over all or part of the axial width of the take-up roller. Each sector also presents at least one thickness that is determined in such a manner as to modify locally the thickness of the profile in relief of the outer surface of the take-up roller.

10 Claims, 6 Drawing Sheets

(51) Int. Cl.
*D03D 49/20* (2006.01)
*D03D 41/00* (2006.01)

(58) Field of Classification Search
CPC ..... B29C 53/8075; B29C 70/222; B29C 53/8083; D03D 25/005; D03D 49/20; D03D 3/08; D03D 41/004; D03D 13/00
See application file for complete search history.

(56) References Cited

U.S. PATENT DOCUMENTS 3,970,492 A * 7/1976 Amberg ..... B29C 61/025 156/85
4,057,001 A * 11/1977 Valentine ..... F42B 12/26 102/494
4,080,915 A * 3/1978 Bompard ..... B29C 70/24 112/412
4,100,009 A * 7/1978 Nakajima ..... B01D 17/045 156/184
4,106,968 A * 8/1978 Kutnyak ..... B29C 53/08 138/130
4,384,913 A * 5/1983 Dana ..... B29C 53/821 156/425
4,519,290 A * 5/1985 Inman ..... B29B 11/16 156/148
4,621,662 A * 11/1986 Olry ..... D04H 18/02 138/129
4,722,369 A * 2/1988 Senn ..... D03D 49/20 139/308
4,825,912 A * 5/1989 Fleury ..... D03D 3/08 139/305
5,113,568 A * 5/1992 Lawton ..... D04H 3/002 29/419.1
7,670,969 B2 * 3/2010 Blackden ..... B29C 70/222 442/239
8,333,222 B2 * 12/2012 Leppla ..... D03D 35/00 139/192
9,186,850 B2 * 11/2015 Goering ..... B29B 11/16
9,403,325 B2 * 8/2016 Corradini ..... B65H 23/0328
9,726,616 B2 * 8/2017 Mathon ..... G01N 21/898
10,016,912 B2 * 7/2018 Dunleavy ..... B29B 11/16
2009/0294566 A1 * 12/2009 Witmer ..... B29C 53/66 242/410
2009/0294567 A1 * 12/2009 Witmer ..... B29C 53/66 242/419
2009/0325443 A1 * 12/2009 Blackden ..... B29C 70/222 442/203
2011/0155276 A1 * 6/2011 Leppla ..... D03D 35/00 139/22
2013/0074297 A1 * 3/2013 Dey ..... D06C 5/00 26/80
2013/0103162 A1 * 4/2013 Costello ..... A61L 31/10 623/23.7
2014/0102578 A1 * 4/2014 Bartel ..... B29C 70/462 138/123
2014/0110063 A1 * 4/2014 Mathon ..... B29C 70/32 156/446
2014/0113088 A1 * 4/2014 Goering ..... F01D 21/045 428/34.5
2014/0246143 A1 * 9/2014 Kendrick ..... B29C 53/821 156/187
2014/0246149 A1 * 9/2014 Kendrick ..... B32B 1/08 156/288
2014/0262046 A1 * 9/2014 Mathon ..... B29C 70/443 156/382
2014/0283977 A1 * 9/2014 Mathon ..... B29C 70/32 156/169
2015/0174833 A1 * 6/2015 Desjoyeaux ..... B29C 70/222 264/241
2015/0239181 A1 * 8/2015 Corradini ..... B65H 23/0328 156/64
2015/0354103 A1 * 12/2015 Dunleavy ..... B29B 11/16 301/9.1
2016/0077019 A1 * 3/2016 Mathon ..... G01N 21/898 356/238.1
2016/0332120 A1 * 11/2016 Oborn ..... B01D 63/061

FOREIGN PATENT DOCUMENTS

EP 2 660 673 A2 11/2013
FR 2 660 673 A1 10/1991
FR 3 018 286 A1 9/2015
WO WO 2006/136755 A2 12/2006

OTHER PUBLICATIONS

International Search Report as issued in International Patent Application No. PCT/FR2017/050470, dated May 10, 2017.

* cited by examiner

INSTALLATION AND A METHOD FOR FABRICATING A FIBER TEXTURE IN THE FORM OF A STRIP PRESENTING A PROFILE THAT VARIES IN CROSS-SECTION

CROSS REFERNCE TO RELATED APPLICATIONS

This application is the U.S. National Stage of PCT/FR2017/050470 filed Mar. 2, 2017, which in turn claims priority to French Application No. 1651741, filed Mar. 2, 2016. The contents of both applications are incorporated herein by reference in their entirety.

BACKGROUND OF THE INVENTION

The present invention relates to using three-dimensional (3D) or multilayer weaving to fabricate fiber reinforcing structures for composite material parts.

More particularly, the invention relates to fiber structures that are to form reinforcement in a composite material part that is a body of revolution presenting, in radial section, a profile that varies (varying in shape and/or in thickness), such as for example an aeroengine fan casing.

Fiber structures that are to constitute the fiber reinforcement of a composite material part, e.g. such as an aeroengine fan casing, are made by 3D or multilayer weaving in a Jacquard type loom, the weaving consisting in inserting weft yarns to create a pattern between warp yarns. The warp yarns are organized in the harness of the loom as a plurality of layers and columns that are manipulated by the loom so as to enable the weft yarns to be inserted in compliance with the weaving pattern(s) programmed in the loom. The weft yarns are inserted between the warp yarns in columns.

In order to enable each column of weft yarns to the inserted while weaving the fiber structure, one or more take-up rollers are used between the outlet of the loom and a storage drum or mandrel onto which the woven fiber texture is wound for subsequent use in forming a fiber preform on an injection mold. The role of this or these take-up rollers located downstream from the loom is to take up the proper lengths of warp yarns after each weft column has been inserted. These rollers have outer surfaces that are covered in a material to which the weaving yarns adhere so as to exert a traction force on the warp yarns.

The fiber texture as woven in this way is to be wound onto an injection mold that is formed by a mandrel having a winding surface presenting, in radial section, a profile in relief corresponding to the profile of the part that is to be fabricated. In order to make a fiber texture that is adapted to the varying shape of the injection mold, use is made of a "contour" weaving technique, which consists in taking up different lengths of warp yarns depending on their positions across the width of the fiber texture that is being woven in the form of a strip. For this purpose, the take-up roller(s) present across their axial width a radius that varies so as to define an outer surface having a profile in relief for taking up different lengths of warp yarn as a function of the positions of the yarns across the width of the fiber texture, a greater length of warp yarn being taken up by the portion(s) of a take-up roller that is/are of radius greater than the remainder of the roller. Differential take-up of the warp yarns depends on the sums of the lengths of fiber texture that are in contact with the take-up rollers. The differential take-up performed by the take-up rollers has the effect, in the weaving cell of the loom, of causing the proper lengths of warp yarns to be pulled prior to inserting the next column of weft yarns.

However, while the fiber texture is being shaped on a mold prior to injection, it is wound to build up a plurality of layers. On each winding turn, the ratios between the various radii defining the profile in relief changes as a function of the number of layers of fiber texture that have already been wound. The magnitudes of these changes in profile increase with increasing shape and/or thickness ratios in the final part. Unfortunately, the above-described fabrication method is capable only of weaving a fiber texture with a profile in relief that is constant, i.e. matching radii for which the cross-section ratios do not change. While the fiber texture is being wound onto the injection mold, it comes out of register because of the differences between the profile as woven, which is constant over the entire length of the woven texture, and the real profile onto which the texture is being wound, thereby giving rise to losses of tension in certain axial positions in the texture. Such unbalances in tension across the width of the part can give rise to numerous defects such as waves, fibers buckling, pinched fibers, zones of unwanted extra thickness, and fiber volume contents that are out of specification. Such unbalances in tension also make the shaping of the fiber texture by winding more complicated, in particular by causing creases or misalignments to be formed, thereby making the shaping of the fiber texture more arduous and time-consuming.

OBJECT AND SUMMARY OF THE INVENTION

It is therefore desirable to be able to make 3D or multilayer fiber structures with a profile in relief that varies during weaving of the texture in such a manner as to avoid losses or unbalances of tension in the fiber texture.

For this purpose, the invention proposes an installation for fabricating a fiber texture in the form of a strip presenting a profile that varies at least in cross-section, the installation comprising a loom, one or more take-up rollers, and a storage mandrel, each take-up roller and the storage mandrel presenting a radius that varies across its axial width so as to define an outer surface having a profile in relief, the installation being characterized in that at least one take-up roller includes a plurality of sectors releasably fastened on the outer surface of said take-up roller, each sector extending over a fraction of the circumference of the take-up roller and over all or part of the axial width of said take-up roller, each sector also presenting at least one thickness that is determined in such a manner as to modify locally the thickness of the profile in relief of the outer surface of the take-up roller.

By making use of sectors that enable the thickness of the profile in relief on the outer surface of one or more take-up rollers to be modified locally during fabrication of a fiber texture of varying shape, the fabrication installation of the invention enables fiber textures to be fabricated in the form of a strip presenting a profile that varies in cross-section in which losses or nonuniformities in tension are significantly reduced. These effects can be seen while winding the texture on the injection mold in order to shape it. Specifically, while being wound on the injection mold, the fiber preform presents few defects (waves, fiber buckling and/or pinching, zones of unwanted extra thickness, fiber volume contents that are out of specification, creases, misalignments, etc.) compared with a fiber texture fabricated in accordance with the prior art in which tension unbalances are greater. This reduces the number of unwanted stops of the winding machine that are usually necessary for the purpose of correcting defects such as creases or collapses of portions of the texture, which defects also require the machine to be reversed and action to be taken by one or more technicians.

According to a first particular characteristic of the installation of the invention, each sector presents a thickness that varies in the axial direction. It is thus possible to conserve or to modify the variation in the radius of the take-up roller.

According to a second particular characteristic of the installation of the invention, each sector presents an inner surface having a shape corresponding to the portion of the outer surface of profile in relief of the take-up roller on which said sector is fastened. Under such circumstances, the increase in the take-up of warp yarns in contact with the sectors is adjusted relative to the take-up of warp yarns performed at the same location, but on the take-up roller without sectors.

According to a third particular characteristic of the installation of the invention, each sector includes a layer of grip material on its outer surface so as to entrain the yarns of the fiber texture in contact with the sectors.

According to a fourth particular characteristic of the installation of the invention, at least one sector of the plurality of sectors has an edge that is chamfered so as to avoid putting the preform into contact with a sharp edge on a first sector that has been added to the take-up roller and so as to cause the take-up force on the yarns to increase progressively.

According to a fifth particular characteristic of the installation of the invention, it comprises a first take-up roller placed in the proximity of the outlet from the loom, and at least one second take-up roller placed between the first take-up roller and the storage mandrel, the second take-up roller including a plurality of sectors releasably fastened on the outer surface of said second take-up roller, each sector extending over a fraction of the circumference of the second take-up roller and over all or part of the axial width of said second take-up roller, each sector also presenting a thickness that is determined in such a manner as to modify locally the thickness of the profile in relief of the outer surface of the take-up roller.

Sectors are thus preferably used with those take-up rollers that are referred to as "reverser" rollers and that present variations in radius that are greater than on the take-up roller(s) that are referred to as "puller" rollers, and that consequently take up greater lengths of warp yarn than the "puller" rollers situated upstream in the winding direction.

The invention also provides a method of fabricating a fiber structure in the form of a strip presenting a varying profile in cross-section by three-dimensional or multilayer weaving between a plurality of layers of warp yarns interlinked by weft yarns, the warp yarns being driven at the outlet from the loom by one or more take-up rollers, the fiber texture being wound onto a storage mandrel placed downstream from the take-up rollers, each take-up roller and the storage mandrel presenting across its axial width a radius that varies so as to define an outer surface having a profile in relief, the method being characterized in that, during weaving, it comprises adding a plurality of sectors on the outer surface of at least one take-up roller, each sector extending over a fraction of the circumference of the take-up roller and over all or part of the axial width of said take-up roller, each sector also presenting at least one thickness that is determined in such a manner as to modify locally the thickness of the profile in relief of the outer surface of the take-up roller.

According to a first particular characteristic of the method of the invention, each sector extends over a fraction of the circumference of the take-up roller, which fraction is determined as a function of the circumferential fraction of contact between the fiber texture and the outer surface of said take-up roller.

According to a second particular characteristic of the method of the invention, each sector presents a thickness that varies in the axial direction.

According to a third particular characteristic of the method of the invention, each sector presents an outer surface having a shape corresponding to the portion of the outer surface of profile in relief of the take-up roller on which said sector is fastened.

BRIEF DESCRIPTION OF THE DRAWINGS

Other characteristics and advantages of the invention appear from the following description of particular embodiments of the invention, given as nonlimiting examples, and with reference to the accompanying drawings, in which.

DETAILED DESCRIPTION OF EMBODIMENTS

The invention applies in general manner to making fiber textures suitable for constituting fiber reinforcement, or "preforms", for fabricating composite material parts in the form of bodies of revolution presenting, in radial section, a profile that varies and/or a thickness that varies, in particular in a radial section, where a radial section corresponds to a plane defined by the axial direction and by the radial direction of the mold on which the preform is shaped. The parts are obtained by winding a fiber texture on a mold and by injecting a matrix precursor into the shaped fiber texture, with the matrix typically being a resin.

The fiber texture of the invention, which is in the form of a strip presenting a profile of varying cross-section, is obtained by three-dimensional weaving or by multilayer weaving.

The term "three-dimensional weaving" or "3D weaving" is used herein to mean a weaving technique in which at least some of the weft yarns interlink warp yarns over a plurality of warp layers, or vice versa. The 3D weaving may be of the interlock type, as described in Document WO 2006/136755.

The term "multilayer weaving" is used herein to mean 3D weaving with a plurality of warp layers in which the base weave for each layer is equivalent to a conventional 2D weave, such as a weave of plain, satin, or twill type, but including certain points of the weave that interlink warp layers, or vice versa.

Fabricating the fiber structure by 3D or multilayer weaving makes it possible to obtain bonding between the layers, and thus to have good mechanical strength for the fiber structure and for the resulting composite material part, and to do so in a single textile operation.

In particular, the fiber structure may be woven using yarns made of fibers of carbon, of ceramic such as silicon carbide, of glass, or indeed of aramid.

Figure 1:
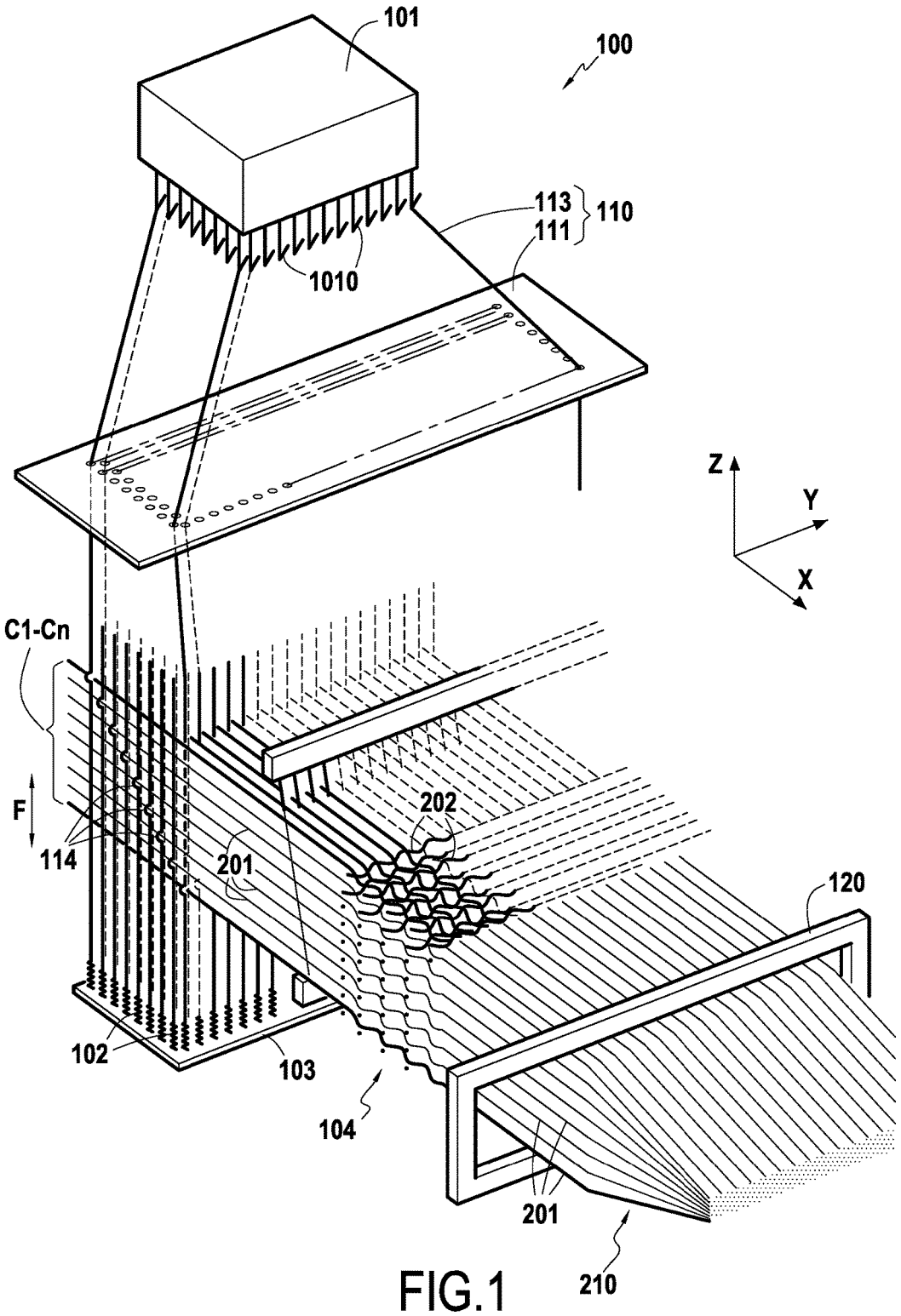
FIG. 1 is a diagrammatic perspective view of a Jacquard type loom.

FIG. 1 shows a loom 100 fitted with a Jacquard mechanism 101 supported by a superstructure that is not shown in FIG. 1. The loom 100 also has a harness 110 constituted by a harness board 111 and control yarns or "heddles" 113, each heddle 113 being connected at one end to a control hook 1010 of the Jacquard mechanism 101 and at the other end to a spring of a set of return springs 102 fastened to the structure 103 of the loom 100. Each heddle 113 has an eyelet 114 through which there passes a warp yarn 201. The heddles 113 and their associated eyelets 114 extend in a zone in which the heddles 113 and the eyelets 114 are caused to perform substantially vertical reciprocating motion as represented by double headed arrow F. The heddles 113 are subjected to traction forces exerted respectively by the control hooks 1010 and by the return springs 102. The heddles 113 enable certain warp yarns 201 to be raised in compliance with a defined weaving program. By raising certain warp yarns 201, the heddles 113 thus create a shed 104 enabling weft yarns 202 to be inserted for 3D or multilayer weaving of a fiber structure 210 in the form of a strip or tape. The warp yarns 201 are organized as a plurality of layers of warp yarns $C_1$ to $C_n$.

The warp yarns 201 are taken from spools arranged on a creel (not shown in FIG. 1) upstream from the Jacquard mechanism 101 of the loom 100.

Figure 2:
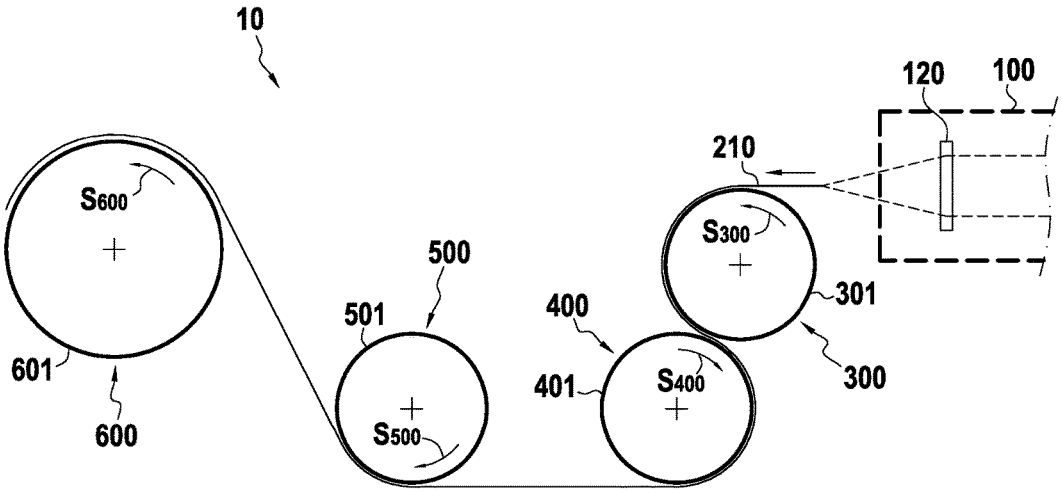
FIG. 2 is a diagrammatic view of an installation for fabricating a fiber texture of varying shape, the installation constituting an embodiment of the invention.

FIG. 2 shows an installation 10 for fabricating a fiber texture of varying shape in accordance with an implementation of the invention. The installation 10 comprises the above-described loom 100 together with three take-up rollers 300, 400, and 500 arranged downstream from the loom. The box 120 defines the outlet from the loom 100, i.e. the zone beyond which the warp yarns 201 are no longer woven with weft yarns 202 and corresponding to the closure of the shed 104.

The first take-up roller 300 that is situated closest to the outlet 120 of the loom 100 is said to be a "puller" roller. The take-up roller 300 is driven in a direction of rotation $S_{300}$ shown in FIG. 2. Across its axial width, it presents a radius that varies so as to define an outer surface 301 having a profile in relief corresponding to the weaving profile specified for the fiber texture 210 so as to have an angle between the warp and weft yarns that is as close as possible to 90°. The outer surface 301 is covered in a material, e.g. a tacking agent, to which the woven yarns adhere so as to exert a traction force on the warp yarns.

The other two take-up rollers 400 and 500 that are situated downstream from the first take-up roller 300 are referred to as "reverser" rollers, and they are driven in rotation in respective directions of rotation $S_{400}$ and $S_{500}$ shown in FIG. 2, which directions are both opposite to the direction of rotation the $S_{300}$ of the take-up roller 300. Across their axial widths, the take-up rollers 400 and 500 likewise present varying radius so as to define respective outer surfaces 401 and 501, each presenting a profile in relief. The variations in a radius on the take-up rollers 400 and 500 are greater than on the take-up roller 300, with the rollers 400 and 500 taking up greater lengths of warp yarns than the take-up roller 300. The outer surfaces 401 and 501 are covered in a material, e.g. a tacking agent, to which the woven yarns adhere so as to exert a traction force on the warp yarns.

The installation 10 also has a storage drum or mandrel 600, also referred to as a "take-up" mandrel, that is driven in rotation in the direction of rotation $S_{600}$ and that likewise presents across its axial width a radius that varies so as to define an outer surface 601 having a profile in relief corresponding to the weaving profile specified for the fiber texture 210, in order to limit deformation of the fiber texture 210. The fiber texture 210 is wound onto the storage mandrel 600 on which it is stored for subsequent use in forming a fiber preform by winding the fiber texture onto an injection mold.

Figure 3:
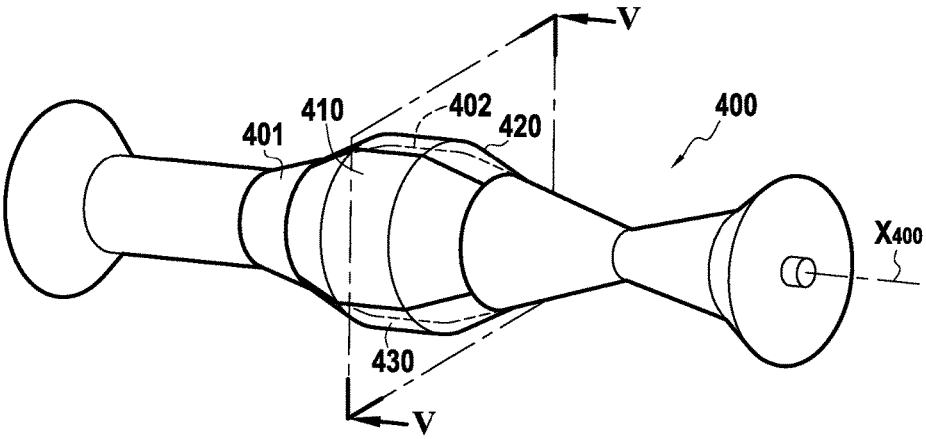
FIG. 3 is a diagrammatic perspective view of a take-up roller of the FIG. 2 installation.
Figure 4:
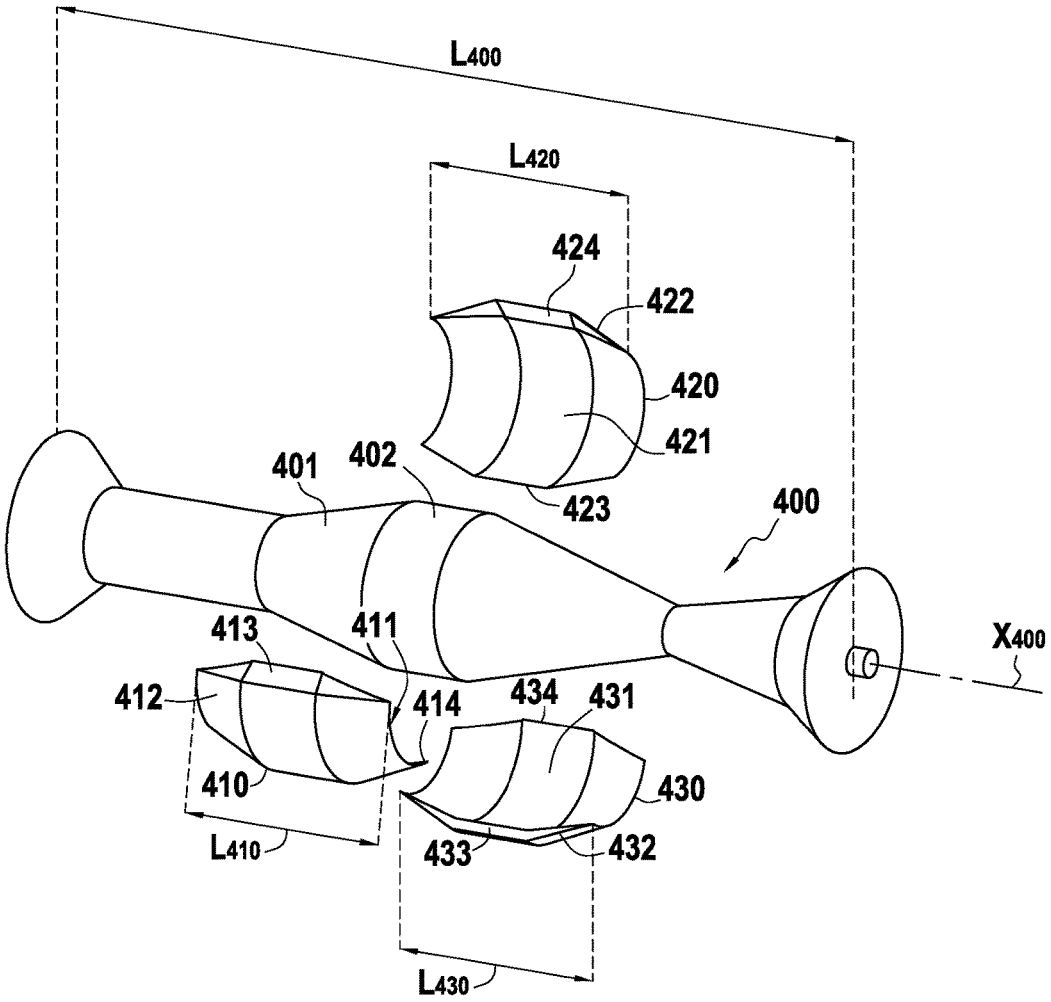
FIG. 4 is an exploded a diagrammatic perspective view of the FIG. 3 take-up roller.
Figure 5:
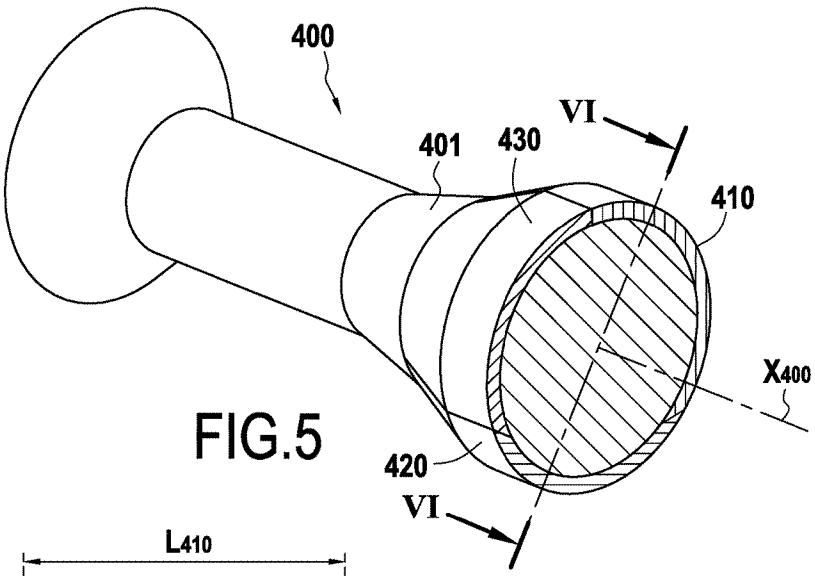
FIG. 5 is a diagrammatic view of the take-up roller in radial section on plane V of FIG. 3.
Figure 6:
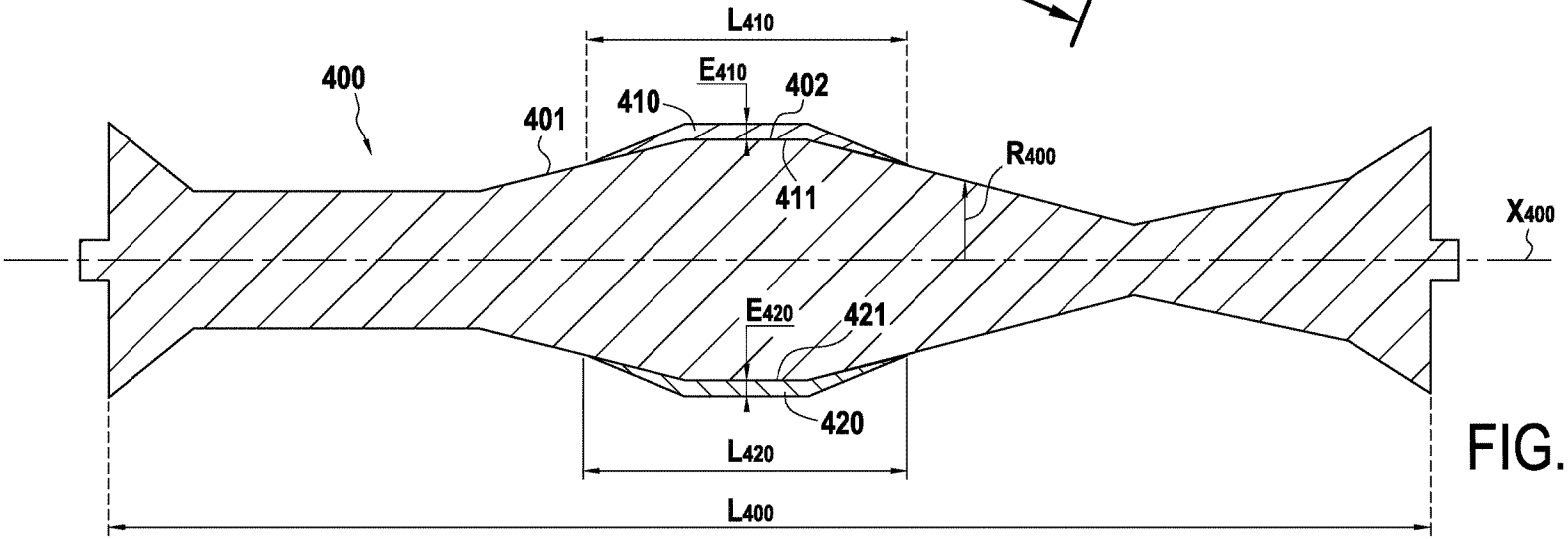
FIG. 6 is a diagrammatic view of the take-up roller in axial section on plane VI of FIG. 5.

In accordance with the invention, at least one take-up roller is provided on its outer surface with a plurality of sectors that are removably attached, e.g. by means of nut-and-bolt type fastener members or by interfitting, each sector extending over a fraction of the circumference of the take-up roller and over all or part of the axial width of said take-up roller. In the presently described example, and as shown in FIGS. 3 to 6, the take-up roller 400 that extends axially along an axis $X_{400}$ and that has a radius $R_{400}$ that varies along the axis $X_{400}$ (FIG. 6), has three sectors 410, 420, and 430, as shown in FIGS. 3 and 4. Still in the presently described example, the sectors 410, 420, and 430 present are less than the axial width $L_{400}$ of the take-up roller 400, with axial widths being measured along the direction of the axis of the roller such as the axis $X_{400}$ for the follower roller 400. The sectors 410, 420, and 430 are for placing on a portion 402 of the take-up roller 400 in which the radius $R_{400}$ varies across the axial width $L_{400}$ so as to define a profile in relief in radial section (FIG. 6). For this purpose, the sectors 410, 420, and 430 have respective inner surfaces 411, 421, and 431 of shape corresponding to the portion 402 of the outer surface 401 of profile in relief of the take-up roller 400 onto which the sectors are to be fastened, and respective outer surfaces 412, 422, and 432 of shape that is determined as a function of the tension adjustment that it is desired to achieve in the portion of the fiber texture that is in contact with the sectors.

The outer surfaces 412, 422, and 432 are covered in a layer of grip material (not shown), e.g. a layer of elastomer (rubber), to which the woven yarns adhere so as to exert a traction force on the warp yarns.

In this example, the sectors 410, 420, and 430 present respective thicknesses that vary across the axial widths $L_{410}$, $L_{420}$, and $L_{430}$ of the sectors 410, 420, and 430, as shown in FIG. 6 for the thicknesses $E_{410}$ and $E_{420}$ of the sectors 410 and 420. In the presently described example, the variation in the thicknesses of the sectors 410, 420, and 430 mainly follows the variation in the radius $R_{400}$, and consequently the shape of the profile in relief on the portion 402, so as to modify locally the thickness of the roller 400 while following the profile in relief of the outer surface of the take-up roller in its portion 402. The sectors can also add extra thickness that is independent of the shape of the profile in relief of the roller.

Once fitted with its sectors 410, 420, and 430, the roller 400 takes up greater lengths of the warp yarns where the warp yarns are in contact with the sectors.

Figure 7:
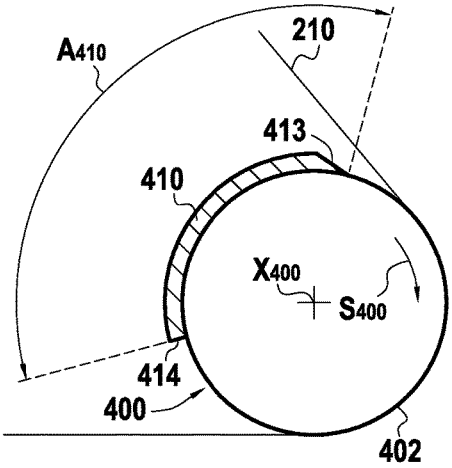
FIGS. 7 to 9 show a sequence of mounting sectors on a take-up roller of the FIG. 2 installation.
Figure 8:
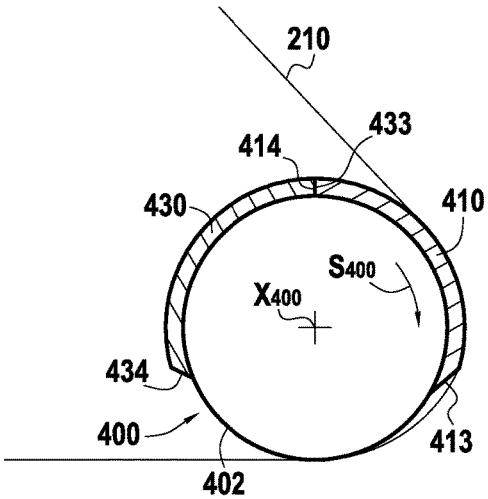
Figure 9:
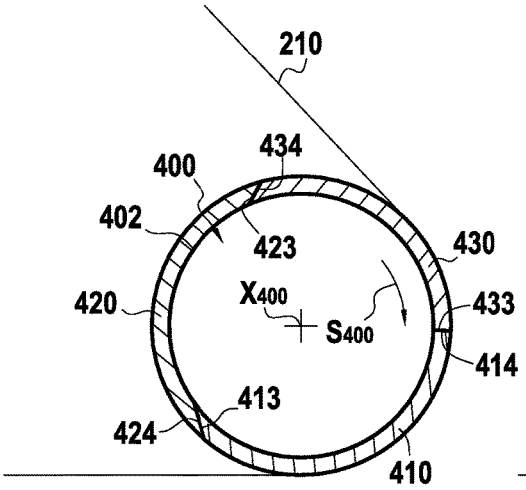
Figure 10:
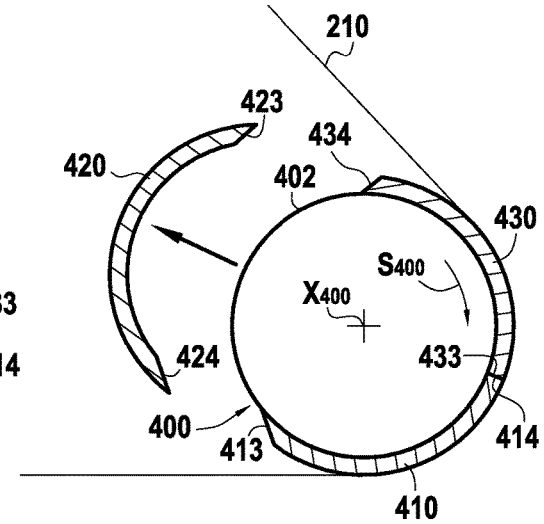
FIGS. 10 to 13 show a sequence of removing sectors from a take-up roller of the FIG. 2 installation.

FIGS. 7 and 9 show how the sectors 410, 420, and 430 are mounted on the take-up roller 400 during fabrication of the fiber texture 210. The sectors are fastened on the outer surface of the take-up roller, e.g. by fastener members such as screws that co-operate with tapping formed in the roller (not shown in figures). As shown in FIG. 7, a first sector, specifically the sector 410, is mounted on the fraction of the portion 402 of the roller 400 that is not in contact with the fiber texture 210. The sector 410, which is the first to come into contact with the texture 210, has a first edge 413 that is preferably chamfered towards the outer surface of the roller so as to avoid putting the preform into contact with a sharp edge on the sector and so as to cause the take-up force on the warp yarns to be increased progressively. The take-up roller 400 then continues to be turned in the direction $S_{400}$ until a new fraction of the portion 402 of the take-up roller 400 is moved out of the zone of contact with the texture 210, thereby enabling the second sector 430 to be mounted (FIG. 8). The edge 433 of the sector 430 is placed against the edge 414 of the sector 410, which is partially in contact with the texture 210. The take-up roller 400 continues to be turned in the direction $S_{400}$ until the last free fraction of the portion 402 of the take-up roller 400 is disengaged from the zone of contact with the texture 210. The third sector 420 is then mounted on the roller 400 (FIG. 9). The edge 424 of the sector 420 is placed against the chamfered edge 413 of the sector 410, the edge 424 having a chamfered shape that is complementary to the shape of the edge 413. The edge 423 of the sector 420 is placed against the edge 434 of the sector 420.

The sectors 410, 420, and 430 are added during fabrication of the fiber texture 210 when it is necessary to take up a greater length of warp yarn, e.g. because the difference between the woven profile and the real profile on which the texture is being wound is such that it can lead to losses of tension at certain axial positions across the texture.

Figure 11:
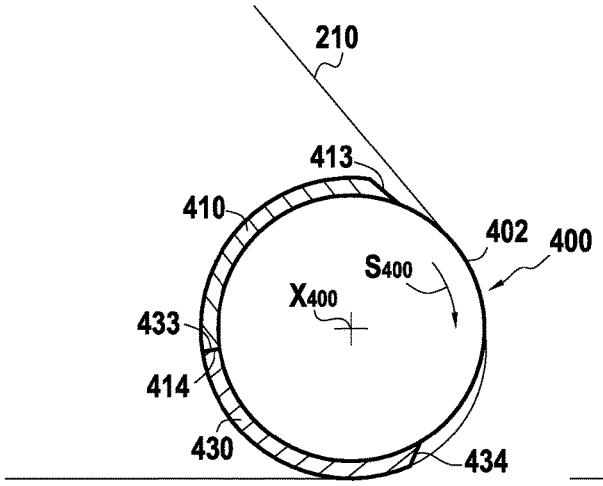
Figure 12:
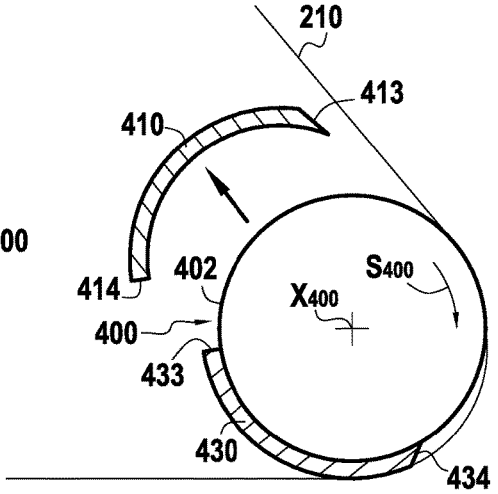
Figure 13:
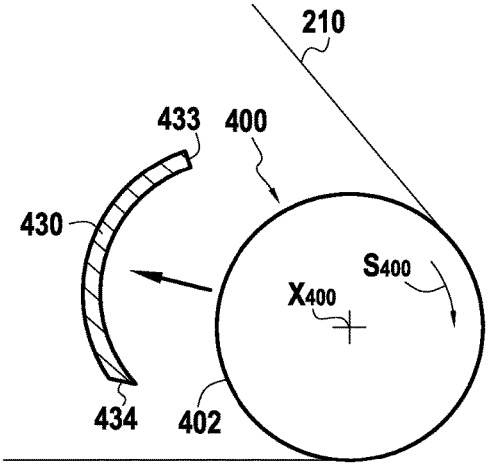

The sectors 410, 420, and 430 are removed in like manner, as shown in FIGS. 10 to 13. During fabrication of the fiber texture 210, the first sector that is not in contact with the fiber texture is removed, this sector corresponding in this example to the sector 420 in FIG. 10. Thereafter, the other two sectors 410 and 430 are removed one after the other, as shown in FIGS. 11 to 13 in such a manner as to reduce the thickness or the radius of the portion 402 of the take-up roller 400. The sector 430, which is the last sector to be removed, has an edge 434 that preferably presents a chamfer oriented towards the outer surface of the roller so as to avoid putting the preform into contact with a sharp edge on the sector, the edge 423 of the sector 420 presenting a chamfered shape that is complementary to the shape of the edge 434.

Each sector extends over a fraction of the circumference of the roller. It presents a circularly arcuate length, such as the circularly arcuate length $A_{410}$ of the sector 410 shown in FIG. 7, which is defined as a function of the circularly arcuate length of the portion of the take-up roller 400 that is not in contact with the fiber texture 210. Consequently, if the fiber texture is in contact with the take-up roller over a relatively short circularly arcuate length, it is possible to use sectors having a relatively long circularly arcuate length, and vice versa. The number of sectors needed to cover the entire circumference of the take-up roller is thus also determined as a function of the circularly arcuate length of the portion of the take-up roller that is not in contact with the fiber texture.

Sectors may be used on a single take-up roller, as described above for the roller 400, or on a plurality of take-up rollers, such as the above-described rollers 300, 400, and 500, so as to modify locally the thickness of the profile in relief of the outer surface of each take-up roller in question. Nevertheless, the sectors are preferably used with the take-up rollers referred to as "reverser" rollers, since they present variations in radius that are greater than on the take-up roller(s) that are referred to as "puller" rollers, and that consequently take up greater lengths of warp yarn than the "puller" rollers. The "reverser" take-up rollers are placed between the "puller" take-up rollers and the storage mandrel in the installation for fabricating a fiber texture in the form of a strip presenting a cross-section of varying profile.

In the context of the invention it is also possible to mount a plurality of sectors on one another so as to increase or decrease progressively the thickness of the profile in relief of the outer surface of any take-up roller.

The sectors are made of rigid material or of material that withstands compression well, such as a metal or a plastics material. By way of example, the sectors may be made by molding, by machining, or by 3D printing.

By making use of sectors that enable the thickness of the profile in relief on the outer surface of one or more take-up rollers to be modified locally during fabrication of a fiber texture of varying shape, the fabrication installation and method of the invention enable fiber textures to be fabricated of varying shape in which losses or nonuniformities in tension are significantly reduced. The effects of the invention on a fiber texture fabricated with the installation and the method of the invention are visible while the texture is being wound onto the injection mold in order to be shaped. Specifically, while being wound onto the injection mold, the shaped fiber preform presents few defects (waves, fiber buckling and/or pinching, zones of unwanted extra thickness, fiber volume contents that are out of specification, creases, misalignments, etc.) compared with a fiber texture fabricated in accordance with the prior art in which tension unbalances are greater. This reduces the number of unwanted stops of the winding machine that are usually necessary for correcting defects such as creases or collapses of portions of the texture, which defects also require the machine to be reversed and action to be taken by one or more technicians.

The invention claimed is:

1. An installation for fabricating a fiber texture in the form of a strip presenting a profile that varies at least in cross-section, the installation comprising a loom one or more take-up rollers, and a storage mandrel each take-up roller and the storage mandrel presenting a radius that varies across its axial width so as to define an outer surface having a profile in relief; wherein at least one take-up roller includes a plurality of sectors releasably fastened on the outer surface of said take-up roller, each sector extending over a fraction of the circumference of the take-up roller and over all or part of the axial width of the take-up roller each sector also presenting at least one thickness that is determined in such a manner as to modify locally the thickness of the profile in relief of the outer surface of the take-up roller.

2. The installation according to claim 1, wherein each sector presents a thickness that varies in the axial direction.

3. The installation according to claim 1, wherein each sector presents an inner surface having a shape corresponding to the portion of the outer surface of profile in relief of the take-up roller on which said sector is fastened.

4. The installation according to claim 1, wherein each sector includes a layer of grip material on its outer surface.

5. The installation according to claim 1, wherein at least one sector of the plurality of sectors has an edge that is chamfered so as to avoid putting the preform into contact with a sharp edge on a sector that has been added to the take-up roller.

6. The installation according to claims 1, comprising a first take-up roller placed in the proximity of the outlet from the loom, and at least one second take-up roller placed between the first take-up roller and the storage mandrel the second take-up roller including a plurality of sectors releasably fastened on the outer surface of said second take-up roller, each sector extending over a fraction of the circumference of the second take-up roller and over all or part of the axial width of said second take-up roller each sector also presenting a thickness that is determined in such a manner as to modify locally the thickness of the profile in relief of the outer surface of the take-up roller.

7. A method of fabricating a fiber structure in the form of a strip presenting a varying profile in cross-section by three-dimensional or multilayer weaving between a plurality of layers of warp yarns interlinked by weft yarns the warp yarns being driven at the outlet from the loom by one or more take-up rollers the fiber texture being wound onto a storage mandrel placed downstream from the take-up rollers, each take-up roller and the storage mandrel presenting across its axial width a radius that varies so as to define an outer surface having a profile in relief; wherein, during weaving, the method comprises adding a plurality of sectors on the outer surface of at least one take-up roller each sector extending over a fraction of the circumference of the take-up roller and over all or part of the axial width of said take-up roller each sector also presenting at least one thickness that is determined in such a manner as to modify locally the thickness of the profile in relief of the outer surface of the take-up roller.

8. The method according to claim 7, wherein each sector extends over a fraction of the circumference of the take-up roller which fraction is determined as a function of the circumferential fraction of contact between the fiber texture and the outer surface of said take-up roller.

9. The method according to claim 7, wherein each sector presents a thickness that varies in the axial direction.

10. The method according to claim 7, wherein each sector presents an outer surface having a shape corresponding to the portion of the outer surface of profile in relief of the take-up roller on which said sector is fastened.

* * * * *